United States Patent [19]

Lee

[11] Patent Number: 4,740,033

[45] Date of Patent: Apr. 26, 1988

[54] INDOOR OR BEACH LOUNGE CHAIR

[75] Inventor: Mark Lee, Taipei, Taiwan

[73] Assignee: Mark Enterprise Co., Ltd., Taipei, Taiwan

[21] Appl. No.: 96,469

[22] Filed: Sep. 15, 1987

[51] Int. Cl.[4] ..... A47C 7/00

[52] U.S. Cl. ..... 297/443; 297/454; 297/458; 297/118; 108/64

[58] Field of Search ..... 297/443, 454, 440, 118, 297/458; 108/64

[56] References Cited

U.S. PATENT DOCUMENTS

| | | | |
|---|---|---|---|
| 2,332,619 | 10/1943 | Walker | 297/454 X |
| 2,793,685 | 5/1957 | Spitz | 297/443 X |
| 3,669,495 | 6/1972 | Von Rudgisch | 297/443 |
| 3,826,206 | 7/1974 | Ruggles | 108/64 |
| 4,379,589 | 4/1983 | Marino | 297/454 |

*Primary Examiner*—Francis K. Zugel
*Attorney, Agent, or Firm*—Morton J. Rosenberg

[57] ABSTRACT

A lounge chair comprising a male seat piece, a female seat piece and a fastener which removably secure the male seat piece to the female seat piece. Both male and female seat pieces comprise casing defining a substantially hexahedral case which is slightly arched in profile; a central part of a side of each of the male and female seat piece is provided with a semicircular cavity and an engaging bar spanning through each of the semicircular cavities; a circular hole is provided at each end beside the semicircular cavity; each of the circular holes of the male seat piece is inserted by a tube with a portion of which exposed to the external. The tubes of the male seat piece are inserted into the circular openings of the female seat piece. The fastener comprises a plurality of fixing plates and clamping plates which are hinged together by a spike, a fixing rod and some screw elements. The fastener has a plurality of hooking members which may be hooked to the engaging bar of the male and female seat pieces. Further translation of the spike along the fastener toward the axle rod will urge the clamping plates to form an angular construction so as to reduce the distance between the two sets of the hooking member.

3 Claims, 6 Drawing Sheets

INDOOR OR BEACH LOUNGE CHAIR

BACKGROUND OF THE INVENTION

The present invention relates to sun, beach or indoor lounge chairs, more particularly, to a readily portable, rest or seat or device having a bulk density less than 1, hereinafter termed a lounge chair.

The prior art contains a plethora of designs and configurations, many no doubt promoted as the ultimate in support and comfort. However, they have limited functionality.

SUMMARY OF THE INVENTION

The present invention relates to an indoor or beach lounge chair comprising:

a male seat piece having casing defining a substantially hexahedral case which is slightly arched in profile; a central part of a side of said male seat piece being provided with a semicircular cavity and an engaging bar spanning through said semicircular cavity; said side being provided with a circular hole at each end beside said semicircular cavity; each of said circular holes being inserted by a tube with a portion thereof exposed to the external;

a female seat piece having a structure identical to said male seat piece, except that said female seat piece does not have any tube inserted into the circular holes thereof; and a fastener which removably secure said male seat piece to said female seat piece, said fastener comprises:

(i) a fixing rod having a perforation at the central part thereof;

(ii) two sets of fixing plate hinged together by inserting said fixing rod through openings at one end of each set of said fixing plate;

(iii) two sets of clamping plate hinged together with said fixing plates by inserting screw elements through openings at the other end of each set of said fixing plate and openings at one end of said clamping plates; an end of each of said clamping plates further extending to define a hooking member; said clamping plates being hinged to one another by inserting an axle rod through openings at the other end of the clamping plates; a threaded hole being formed on a central part of said axle rod; and (iv) a spike passing through said perforation of said fixing rod and being screwed up in said threaded hole of said axle rod;

said tubes of said male seat piece being inserted into said circular openings of said female seat piece and said hooking members of said fastener being hooked to said engaging bars of said male and female seat pieces; and whereby further translation of the spike along the fastener toward the axle rod will urge the clamping plates to form an angular construction, thereby reducing the distance between the two sets of the hooking member.

It is a primary object of the present invention to provide a lounge chair which is suitable in used in any circumference or for one to carry out indoor or outdoor activities.

Another object of the present invention is to provide a lounge chair which can be constructed in two different configurations to suit the intended use and can be disassembled into two seat pieces.

A further object of the present invention is to provide a lounge chair of the character referred to whereby it is possible to easily transport it from place to place over difficult terrain or long distances.

Another object of the present invention is to provide a lounge chair which is not only compact, but is light in weight and yet sufficiently strong to withstand the wear of many season's severe service and the effect of intense weather conditions encountered at seashores and lawns when continually exposed to dampness, sunshine, wind and sand.

A further object of the present invention is to provide a lounge chair comprising two seat pieces and a fastener for removably secure the two seat pieces.

Still another object of the present invention is to provide a lounge chair comprising a fastener having a plurality of hooking members. Clamping plates having hooking members will assumed an acute angle construction to ensure that the two seat pieces of the lounge chair are firmly fastened.

Further objects and advantages will become apparent from a careful reading of the detailed description provided hereinafter, with appropriate reference to the attached drawings.

DETAILED DESCRIPTION OF THE PREFERRED EMBODIMENT

Figure 1:
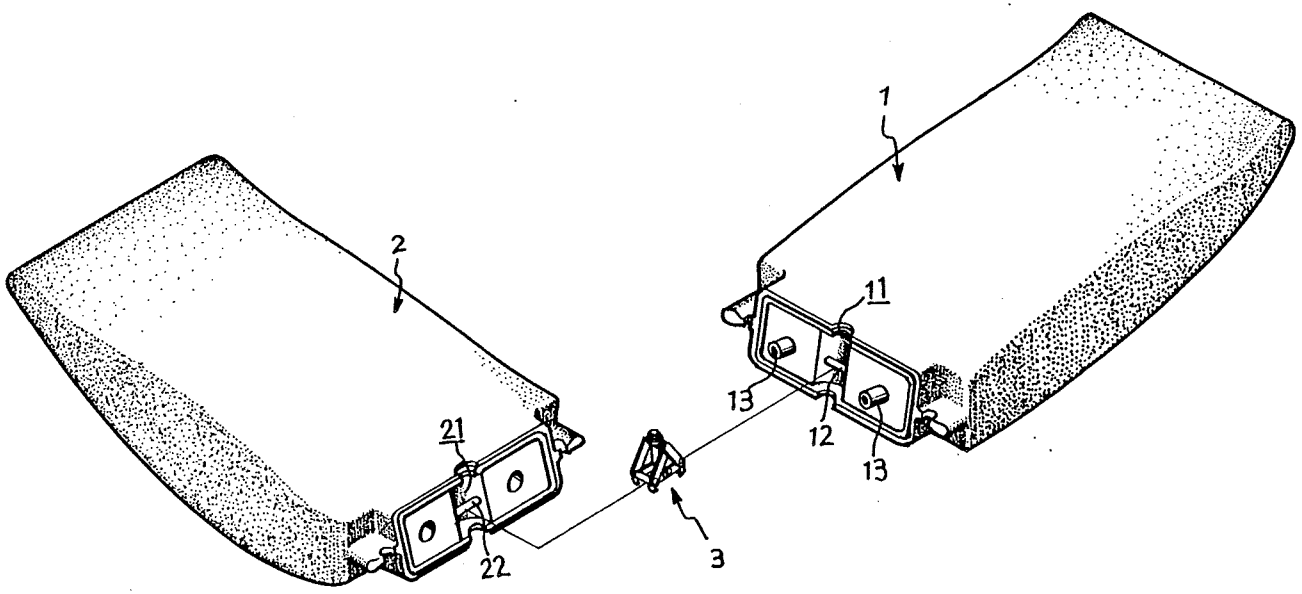
FIG. 1 is an exploded view of a lounge chair in accordance with the present invention.

Referring to the drawings and initially to FIG. 1, it can be seen that the lounge chair constructed in accordance with the present invention comprises a male seat piece 1, a female seat piece 2, and a fastener 3 which removably secure the male seat piece 1 to the female seat piece 2 to prevent movement thereof.

Both of the male and female seat pieces, 1 and 2, comprise casing defining a substantially hexahedral case which is, preferably, slightly bow or arched in profile. The casing of the male and female seat pieces, 1 and 2, are made of FRP (fiberglass-reinforced plastics) and the cases thus formed are filled with foamed plastics internally. A semicircular cavity, 11 and 12, is formed on the contact surfaces of the two seat pieces, 1 and 2, respectively. Each of the semicircular cavities, 11 and 12, is provided with an engaging bar, 12 and 22, that spanning through the cavities respectively. Each contact surface has a circular hole at each side of the semicircular cavity, 11 and 12. The male seat piece 1 has a tube 13 inserted into each of the circular holes thereof with a portion of the tube remained exposed to the external.

Figure 2:
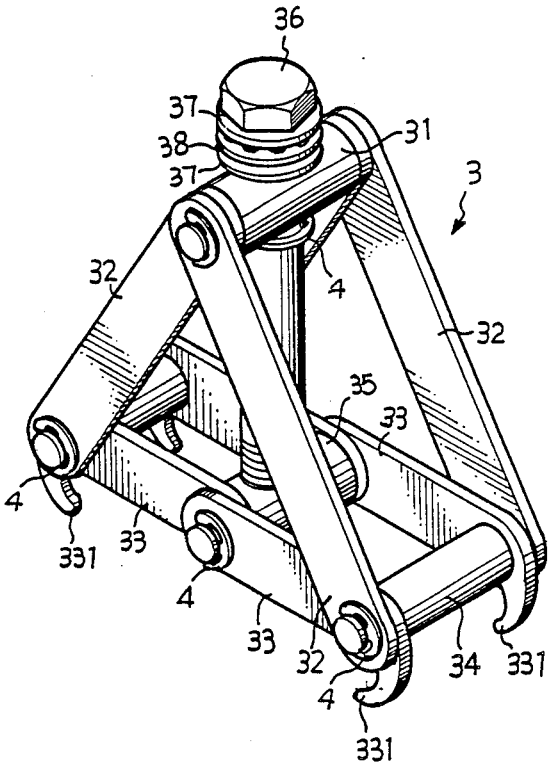
FIG. 2 is a perspective view of a fastener used in accordance with the present invention.

Referring to FIG. 2, a fastener for removably securing the male and female seat pieces generally designated by the reference numeral 3, is substantially triangular in shape when viewed from the front or rear side and includes a fixing rod 31, two sets of fixing plate 32, two sets of clamping plate 33, two screw elements 34, an axle rod 35 and a spike 36.

The two sets of fixing plates 32 are hinged together by inserting the fixing rod 31 through openings at one end of each set of the fixing plates 32. The two sets of fixing plates 32 further hinge with the clamping plates 33 correspondingly by inserting the screw elements 34 through openings at the other end of each set of the fixing plates 32 and openings at one end of the clamping plates 33, The clamping plates 33 hinge to one another by inserting an axle rod 35 through openings at the other end of the clamping plates 33.

Both ends of each of the fixing rod 31, screw elements 34, and axle rod 35 are set with grooves. A E-shaped stop member 4 is employed to fit into each of the grooves so as to firmly fix the above-mentioned elements together.

A perforation 311 is formed on a central part of the fixing rod 31. A threaded hole 351 is formed on a central part of the axle rod 35. The spike 36 passes through the perforation 311 and is screwed up in the threaded hole 351. The spike 36 is, preferably, provided with two pads 37 and a bearing 38 at a predetermined location which is positioned to be between the fixing rod 31 and the head of the spike 36. The bearing 38 is sandwiched between the two pads 37 and they are provided to facilitate the rotation of the spike 36 with respect to the fixing rod 31. A groove is formed at a predetermined part surrounding the spike 36 which is located to be slightly below the position of fixing rod 31 after fabricated, in which a E-shaped stop member 4 can be fitted. These are so provided in order that the spike 36 is firmly fixed. Additionally, an end of each of the clamping plates 33 further extends to define a hooking member 331.

Figure 3:
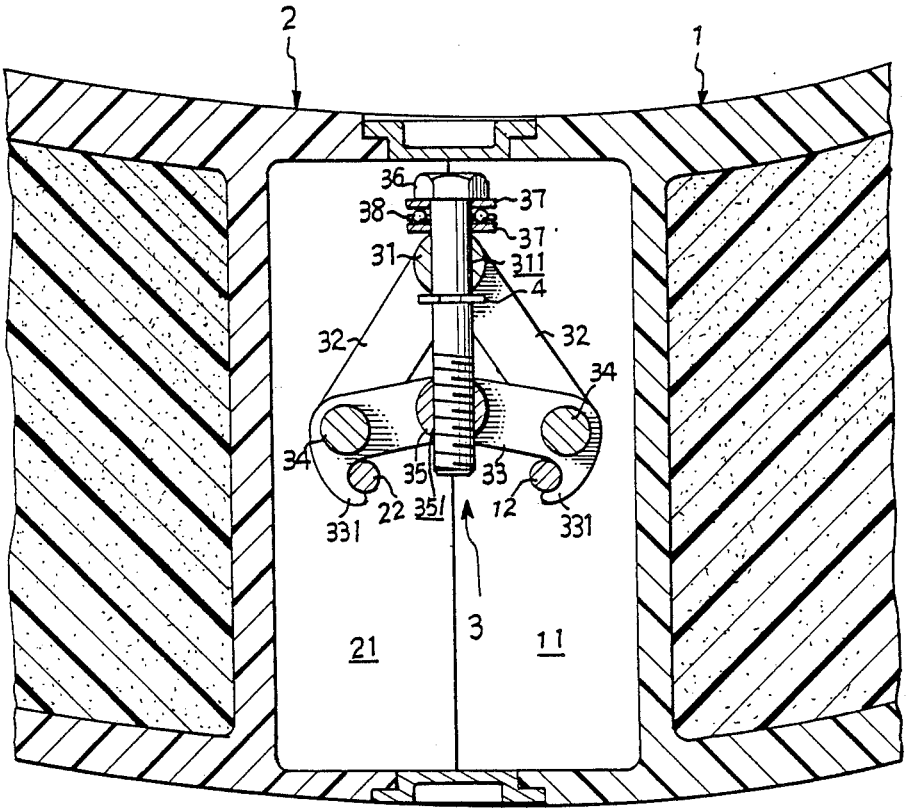
FIG. 3 is a partial sectional view of a lounge chair illustrating the junction of its assembled configuration.

The lounge chair in accordance with the present invention could be assembled as depicted most clearly in FIGS. 1 and 3. The tubes 13 of the male seat piece 1 are inserted into the circular openings of the female seat piece 2. Two different combinations are resulted as can be clearly seen in FIGS. 4 and 5. The fastener 3 is fabricated inside the cavity formed by the semicircular cavities, 11 and 21, of the male and female seat pieces, 1 and 2, with the hooking members 331 of the fastener 3 hooked to the engaging bars, 12 and 22, of the male and female seat pieces, 1 and 2, respectively. The spike 36 is then screwed, causing the axle rod 35 to move in a direction towards the fixing rod 31. The clamping plates 33, initially at linear position, are urged to form an angle with the corresponding clamping plates 33 (upon front or rear elevational view, see FIG. 3), thereby reducing the distance between the two sets of hooking member 331 so as to attain a tightening effect. Two covering pads (not shown) are, preferably, respectively fitted into the cavities formed by the male and female seat pieces, 1 and 2, to prevent the permeation of water into the seat pieces, 1 and 2.

Figure 4:
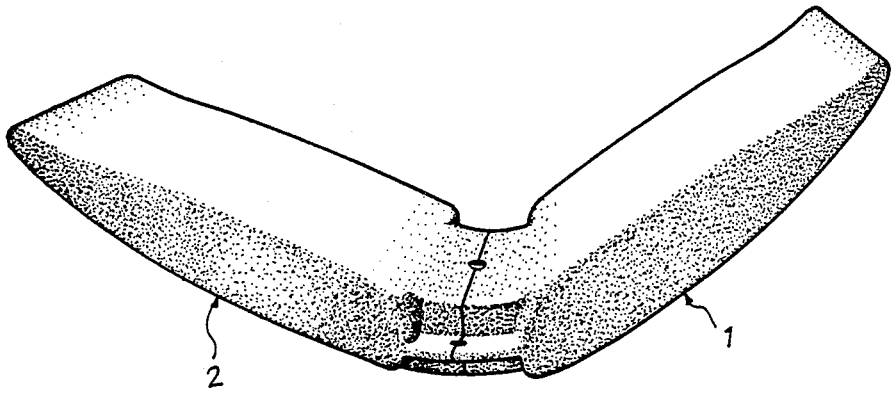
FIG. 4 is a perspective of a lounge chair in accordance with the present invention.
Figure 5:
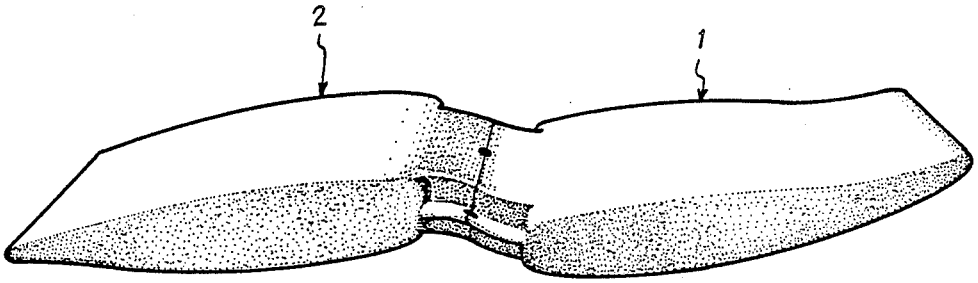
FIG. 5 is a perspective view of the lounge chair of FIG. 4 assembled in another configuration.
Figure 6:
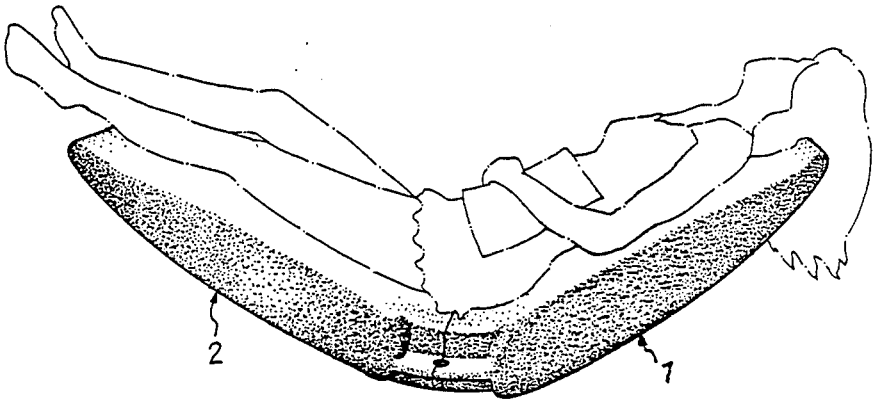
FIG. 6 is a perspective view embodying the utilization of the present invention.

Referring to FIGS. 4 and 6, it can be seen that the lounge chair constructed in accordance with the present invention can be used as a rocker or leisure chair. Referring to the preferred form shown most clearly in FIG. 5, the lounge chair assembled in this way can be used to float on water level and one may lie on or crouch on the device thus formed. In short, the lounge chair according to the present invention can also serve as a floating object. Additionally, the male and female seat pieces, 1 and 2, independently, can serve as a surfboard or water ski-board.

While the invention has been explained in relation to its preferred embodiments, it is to be understood that various modifications thereof will become apparent to those skilled in the art upon reading this specification. Therefore, it will be appreciated that the invention disclosed herein is intended to cover all such modifications as fall within the scope of the appended claims.

I claim:

1. An indoor or beach lounge chair with a bulk density less than 1, comprising:

a male seat piece having casing defining a substantially hexahedral case which is slightly bow or arched in profile; a central part of a side of said male seat piece being provided with a semicircular cavity and an engaging bar spanning through said semicircular cavity; said side being provided with a circular hole at each end beside said semicircular cavity; each of said circular holes being inserted by a tube with a portion thereof exposed to the external;

a female seat piece having a structure identical to said male seat piece, except that said female seat piece does not have any tube inserted into the circular holes thereof; and a fastener which removably secures said male seat piece to said female seat piece, said fastener comprises:

(i) a fixing rod having a perforation at the central part thereof;

(ii) two sets of fixing plates hinged together by inserting said fixing rod through openings at one end of each set of said fixing plates;

(iii) two sets of clamping plates hinged together with said fixing plates by inserting screw elements through openings at the other end of each set of said fixing plates and openings at one end of said clamping plates; an end of each of said clamping plates further extending to define a hooking member; said clamping plates being hinged to one another by inserting an axle rod through openings at the other end of the clamping plates; and a threaded hole being formed on a central part of said axle rod; and (iv) a spike passing through said perforation of said fixing rod and being screwed up in said threaded hole of said axle rod;

said tubes of said male seat piece being inserted into said circular openings of said female seat piece and said hooking members of said fastener being hooked to said engaging bars of said male and female seat pieces;

whereby further translation of the spike along the fastener toward the axle rod will urge the clamping plates to form an angular construction, thereby reducing the distance between the two sets of the hooking member.

2. An indoor or beach lounge chair as set forth in claim 1, wherein both ends of each of said fixing rod, screw elements, and axle rod of said fastener are set with grooves, in which a E-shaped stop member is fitted.

3. An indoor or beach lounge chair as set forth in claim 1, wherein said spike of said fastener is provided with two pads and a bearing at a predetermined location which is positioned to be between said fixing rod and the head of said spike and that said bearing is sandwiched between said two pads.

* * * * *